US005529554A

United States Patent [19]

Eschenbach

[11] Patent Number: 5,529,554

[45] Date of Patent: Jun. 25, 1996

[54] COLLAPSIBLE EXERCISE MACHINE WITH MULTI-MODE OPERATION

[76] Inventor: Paul W. Eschenbach, 143 Lakeland Ave., Moore, S.C. 29369

[21] Appl. No.: 262,008

[22] Filed: Jun. 17, 1994

Related U.S. Application Data

[63] Continuation-in-part of Ser. No. 50,636, Apr. 22, 1993, Pat. No. 5,352,169.

[51] Int. Cl.[6] ..... A63B 22/06; A63B 22/00

[52] U.S. Cl. ..... 482/57; 482/70

[58] Field of Search ..... 482/51, 52, 57, 482/70, 71

[56] References Cited

U.S. PATENT DOCUMENTS

| | | | |
|---|---|---|---|
| 3,316,898 | 5/1967 | Brown | 482/51 |
| 5,038,758 | 8/1991 | Iams et al. | 482/57 |
| 5,242,343 | 9/1993 | Miller | 482/51 |
| 5,279,529 | 1/1994 | Eschenbach | 482/57 |
| 5,279,530 | 1/1994 | Hess | 482/70 |
| 5,290,211 | 3/1994 | Stearns | 482/51 |
| 5,299,993 | 4/1994 | Habing | 482/51 |
| 5,352,169 | 10/1994 | Eschenbach | 482/51 |

FOREIGN PATENT DOCUMENTS

| | | | |
|---|---|---|---|
| 2919494 | 11/1980 | Germany | 482/57 |

*Primary Examiner*—Stephen R. Crow

[57] ABSTRACT

An exercise apparatus having a collapsible frame that simulates walking, running and climbing depending upon where the foot is positioned along the elongate pedal. The user is able to maintain a standing posture while elongate pedals supporting each foot move through an exercise cycle having a different mode for each foot position that includes translating and non-parallel angular motion generated by a linkage mechanism.

19 Claims, 8 Drawing Sheets

COLLAPSIBLE EXERCISE MACHINE WITH MULTI-MODE OPERATION

This application is a Continuation In-Part of U.S. patent application Ser. No. 08/050636 entitled COLLAPSIBLE EXERCISE MACHINE, filed Apr. 22, 1993, now U.S. Pat. No. 5,352,169.

BACKGROUND OF THE INVENTION

1. Field

The present invention relates to an exercise apparatus that simulates walking, running and climbing. More particularly, the present invention relates to an exercise machine having separately supported elongate pedals exhibiting programmed motion in conjunction with a collapsible frame.

2. State of the Art

The benefits of regular exercise to improve overall health, appearance and longevity are well documented in the literature. For exercise enthusiasts the search continues for a safe apparatus that provides maximum benefit in minimum time which can be stowed when not in use.

The sit down exercise cycle is the most commonly used apparatus today to elevate the heart rate and exercise some of the leg muscles. To achieve any significant benefit, however, an extensive amount of time is demanded of the user resulting in boredom. The Lifecycle, U.S. Pat. No. 4,358,105 leads a popular trend to reduce the boredom of sit down cycling by offering programmed load resistance changes over many minutes of cycling and a clever display to capture the attention of the user. However, the issue of extensive time, limited muscle usage and collapsibility for stowage are not fully addressed.

In recent years, stair climbers have become very popular due to the higher loading possible with stand-up exercise as well as different muscles used compared to sit-down cycling. The Stairmaster U.S. Pat. No. 4,708,338 is one of the most popular stairclimbers allowing up and down independent parallel foot pedal movement with programmed load variation over multiple cycles as well as a clever display to hold the attention of the user. Other stairclimbers U.S. Pat. Nos. 4,989,858 and 5,013,031 provide reciprocating foot motion but with non-parallel pedal control and differing load resistance systems.

Another group of stair climbers U.S. Pat. Nos. 4,687,195; 4,726,581 and 4,927,136 have moving stairs requiring the user to remove the foot from each stair after the down stroke. While this foot motion is more diverse than the reciprocating motion of most stair climbers, the issue of operator safety requires complex solutions for practical apparatus.

Stand-up pedaling approaches the the benefits of running to the cardiovascular system because a higher load resistance is possible over sit down cycling. Dr. Cooper in his book entitled THE AEROBICS PROGRAM FOR TOTAL WELL-BEING by Dr. Kenneth H. Cooper, Bantam Books, New York, 1982 awards only half the benefit points to sit-down stationary cycling (page 260) over regular cycling which includes an equal amount of uphill and downhill course (page 255). Dr. Cooper grades running better than regular cycling, but without the downhill rest inherent in regular cycling, it is certain that stand-up pedaling would be equivalent to running for cardiovascular benefits in less time.

Stand-up cycling is described in various patents such as U.S. Pat. No. 3,563,541 (Sanquist) which uses weighted free pedals as load resistance and side to side twisting motion.

Also U.S. Pat. Nos. 4,519,603 and 4,477,072 by DeCloux describe stand-up cycling with free pedals in a lift mode to simmulate body lifting after the lower dead center pedal position to the other pedal in the higher position. A brake or clutch system is deployed to load or stop the lower pedal while the weight is transferred to the other pedal after the crank has passed through the dead center position. All of these stand-up cycling patents mentioned use free pedals which are free to rotate about one pivot point on the crank. Stand-up pedaling is safer when the free pedal is fully constrained to become a platform capable of providing body balance on one foot with minimum hand support.

An attempt to stabilize the pedal using a linkage is shown by Boyd in U.S. Pat. No. 1,323,004 with his mechanism for propelling bicycles. A lever is applied to the pedal to increase the mechanical advantage of the crank during the power stroke. The weight of the body is supported by the ball of the foot only and the lower most position of the pedal shows a severe incline (see Boyd FIG. 3). Boyd does not address the pedal positions necessary for for stand-up pedaling which simulate walking. Geschwender in U.S. Pat. No. 4,786,050 shows a stand-up exercise machine where elongate pedals are supported by double rotating cranks. The pedal positions shown in FIGS. 2 and 3 do not anticipate pedal inclines needed to simulate walking or running.

Parallel motion pedal constraint is shown in U.S. Pat. No. 4,643,419 (Hyde) where pulleys of the same size are coupled with a belt or chain to maintain a pedal platform horizontal or parallel to a base through a rotatable cycle of motion. Parallel pedal motion using a parallelogram linkage is shown in U.S. Pat. No. 4,708,338. Another popular stand-up exerciser is sold by Diversified Products of Opelika, Ala. as the DP Air Strider. The Air Strider provides a pedal platform constrained by two equal length cranks which are coupled by a chain riding on equal diameter sprockets giving parallel horizontal pedal motion similar to Hyde. While parallel platforms help stablize the balance of the user, the heel of the foot raises from the platform during operation when the knee is bent in the upper positions of pedal platform movement. The ankle ligaments and particularly the Achilles tendon are subjected to excessive stress when the heel is raised forcing all weight on that leg to be supported by the ball of the foot.

Eschenbach in U.S. Pat. No. 5,279,529 shows three different linkages suitable for stand-up exercise that fully support the toe and heel of the foot throughout a 360 degree pedal cycle but does not address collapsibility. Miller in U.S. Pat. No. 5,242,343 shows several linkages for stand-up exercise where the elongate pedal has inclined reciprocating motion on the toe end of the peal during a crank cycle but does not anticipate the importance of heel contact with the pedal during a pedal cycle or collapsibility. Kummerlin and Baer in German Pat. No. 2919494 show a stand-up exercise machine with movable handles and an elongate pedal for different foot positions where the toe of the foot faces the crank but do not anticipate the importance of heel contact with the elongate pedal during the pedal cycle.

Ruegsegger in U.S. Pat. No. 3,475,021 shows a skier training device which has foldable pole handles that pivot about a base frame. Iams and Splane in U.S. Pat. No. 5,038,758 show a collapsible framework useful for decompressing the spine. Hess in U.S. Pat. No. 5,279,530 shows a collapsible framework for lower back rehabilation exercise. Holzapfel in German Pat. No. 2730892 shows a collapsible exercise machine to simulate a back and forth ski motion of the feet. Neither Ruegsegger, Iams and Splane, Hess nor Holzapfel address collapsibility for stand-up walking or running exercise.

There is a need for an exercise machine that can be used in the stand-up mode that provides a stable pedal platform which inclines as the knee is bent thus obviating the need to raise the heel off the pedal platform whereby unwanted stress is removed from the ankle ligaments and from the Achilles tendon. There is also a need for a multi-mode exercise machine which simulates walking, running and climbing all in one machine to reduce the boredom of exercise and to exercise a greater range of muscle groups. There is a further need to provide a stand-up exercise machine that can be collapsed when not in use for easy stowage where floor space is scarce as in small apartments or college dorms.

SUMMARY OF THE INVENTION

The present invention relates to the kinematic motion control of elongated pedals which simulate walking, running and climbing during operation and where the supporting frame is collapsible for easy stowage when not in use. More particularly, apparatus is provided that offers variable intensity exercise through a leg operated, cyclic motion multi-mode exercise in which the elongate pedal supporting each foot is guided through successive positions during the motion cycle while load resistance acts upon the crank mechanism. The apparatus includes a separate elongate pedal for each foot having several foot positions, each elongate pedal partially supported by a rotary crank which normally completes one full revolution during a cycle and is phased approximately 180 degrees relative to the crank for the other elongate pedal through a bearing journal attached to the framework. The elongate pedals are not free to rotate but are supported at the other end in one embodiment by a roller element which is attached to the elongate pedal and in contact with a track attached to the frame to form a four-bar linkage known in the literature as a slider-crank mechanism where the elongate pedal is the coupler link.

The elongate pedal simulates walking, running or climbing depending upon where the foot of the user is placed on the elongate pedal. A walking mode is simulated when the feet are placed farthest away from the crank. A running simulation mode occurs with the feet positioned mid-way upon the elongate pedals whereby the feet are raised higher than the walking mode. Climbing is simulated as the third mode when the feet of the user are placed near the crank end of the elongate pedal giving each foot an even higher lift.

The frame is made collapsible with the use of telescoping tubing being an integral part of the track supporting the roller element. The frame is coupled using rotary joints whereby the crank journal housing is allowed to collapse when the tubing telescopes. Both elongate pedals become nearly parallel to the roller track. An adjustable handlebar is pivoted near the forward rotary frame joint allowing the handlebar to move positions to accommodate different locations of the feet upon the elongate pedals and to collapse with the frame becoming nearly parallel to the frame tracks. Load resistance is applied by a compact adjustable friction brake coupled to the crank and attached to the frame.

In another embodiment, the roller element and track supporting the elongate pedals becomes a second crank with one end pivotally attached to the elongate pedal and the other end rotably attached to the frame independent of the similar crank on the other side of the frame. This mechanism is called a crank-rocker where the elongate pedal would be the coupler link.

It will be appreciated that neither embodiment using a friction brake requires the momentum of a flywheel to carry the pedals through the dead center positions. Therefore, one-way clutches are not needed as a safety feature in this invention to prevent the flywheel motion from driving pedals when the user stops. With friction load resistance, the rotary crank stops almost immediately when the user discontinues the application of foot force. Without one-way clutches, the rotary crank can be driven in the reverse direction to exercise different muscles.

In summary, the application of positive non-parallel elongate pedal position control affords the benefits of a safer stand-up exercise apparatus having low ankle/Achilles tendon stress compared to parallel platform control. Boredom is limited with multi-mode operation offering simulation of walking, running and climbing. A collapsible handle and frame allow easy stowage when not in use.

DETAILED DESCRIPTION OF THE EMBODIMENT

Figure 1:
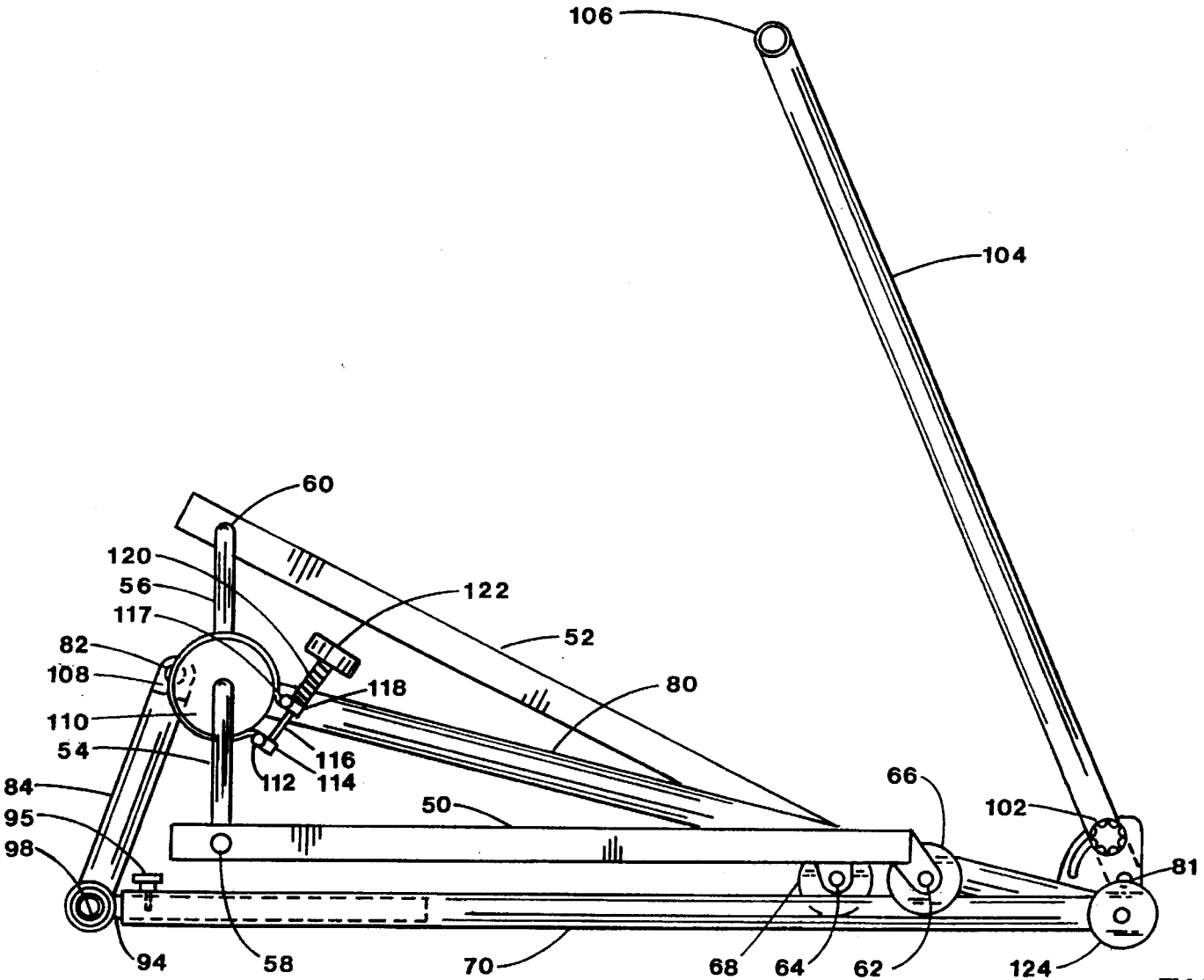
FIG. 1 is a right side elevation view of the preferred embodiment of an exercise machine constructed in accordance with the present invention.
Figure 2:
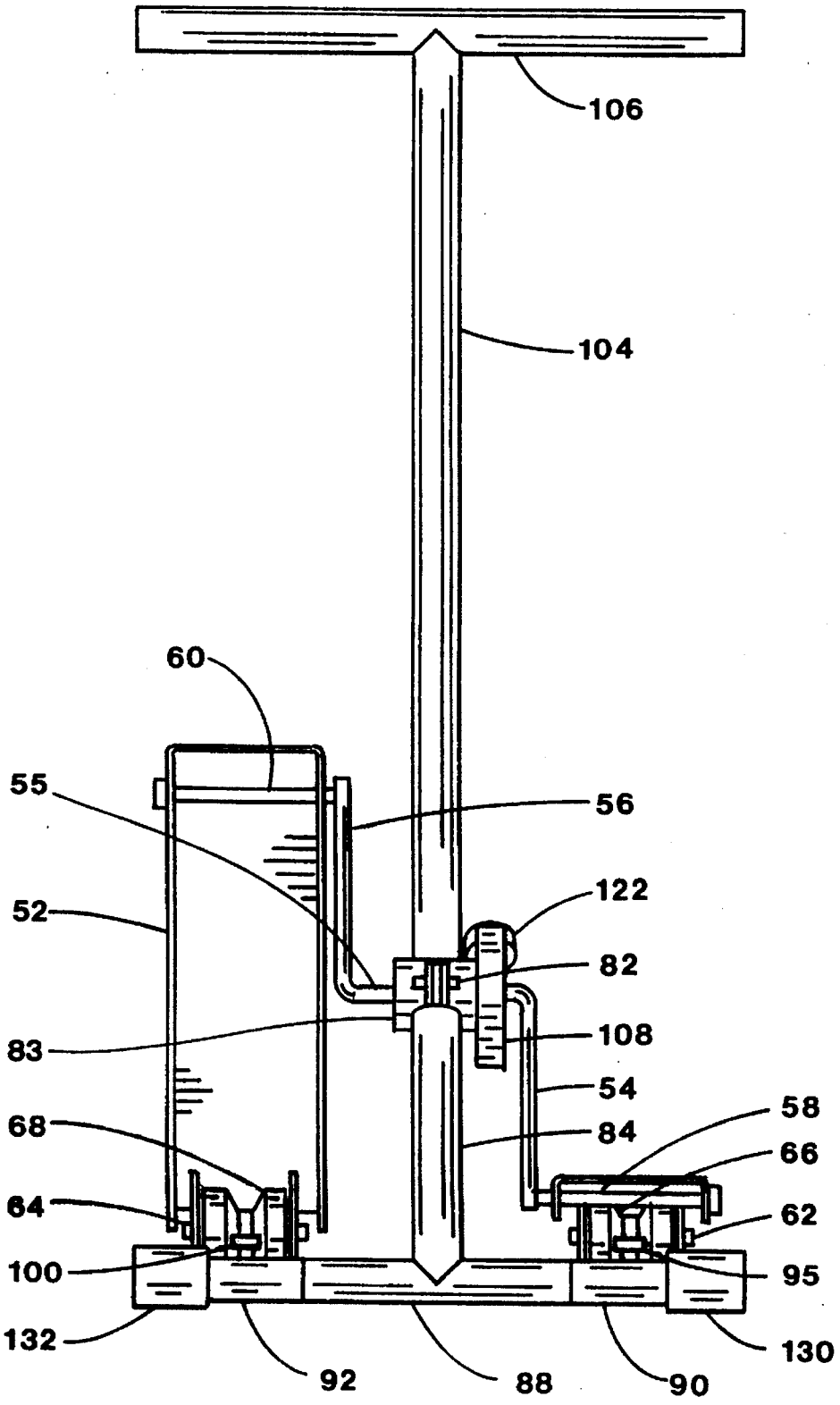
FIG. 2 is the rear view of the preferred embodiment shown in FIG. 1.

Referring to the drawings in detail, elongate pedals 50 and 52 are shown in FIGS. 1 and 2 in the lowest and highest positions, respectively. Crank 54 is rotatably attached to pedal 50 by crank pin 58 while crank 56 is rotatably attached to pedal 52 by crank pin 60. Cranks 54 and 56 are connected by crankshaft journal 55 which is rotatably secured to bearing housing 83. Concave rollers 66 and 68 are rotatably attached to pedals 50 and 52 by roller pins 62 and 64 and are supported by tubular frame members 70 and 72 which form tracks for the rollers.

Frame tubing 70 is welded to tubing 78 and telescopically connected to smaller tubing 94 which is welded to tubing 90. Similarly, frame tubing 72 is welded to tubing 74 and telescopically connected to smaller tubing 96 which is welded to tube 92. Frame tubing 90 and 92 are welded to a smaller diameter concentric tubing 98 while frame tubing 74 and 76 are welded to a similar smaller concentric tubing 75 (not shown). Tubing 76 is welded to frame tubing 80 but is free to rotate about concentric tube 75. Tubing 88 is welded to tube 84 and is also free to rotate about concentric tubing 98. Frame member 80 is welded to bearing housing 83 which is rotatably connected to frame tubing 84 at bolt joint 82.

To collapse the frame, locking screws 95 and 100 are loosened from tubes 94 and 96 allowing these tubes to telescopically extend from tubes 70 and 72. Tube 76 rotates on tube 75, tube 88 rotates on tube 98 while tube 84 rotates about bolt joint 82.

Handlebar 106 is welded to tubing 104 which is pivotally attached to frame 80 by bolt 81 and is adjustably secured by locking screws 102 and 104.

Brake drum 110 is fixed to crankshaft 55 and rotates with cranks 54 and 56. Brake band 108 is concentric to brake drum 110 and is attached at one end to frame 80 by bolt 117 which is common to spring stop 118. The other end of brake band 108 is connected to a threaded nut 114 by bolt 112. Nut 114 is connected to spring stop 118 by threaded rod 116 which has load adjustment knob 122 attached. Load spring 120 is concentric with rod 116 and compressed between knob 122 and spring stop 118. Clockwise rotation of knob 120 will increase spring compression to cause the brake band 108 to experience a closing force creating a frictional load on brake drum 110 as it rotates.

Figure 3:
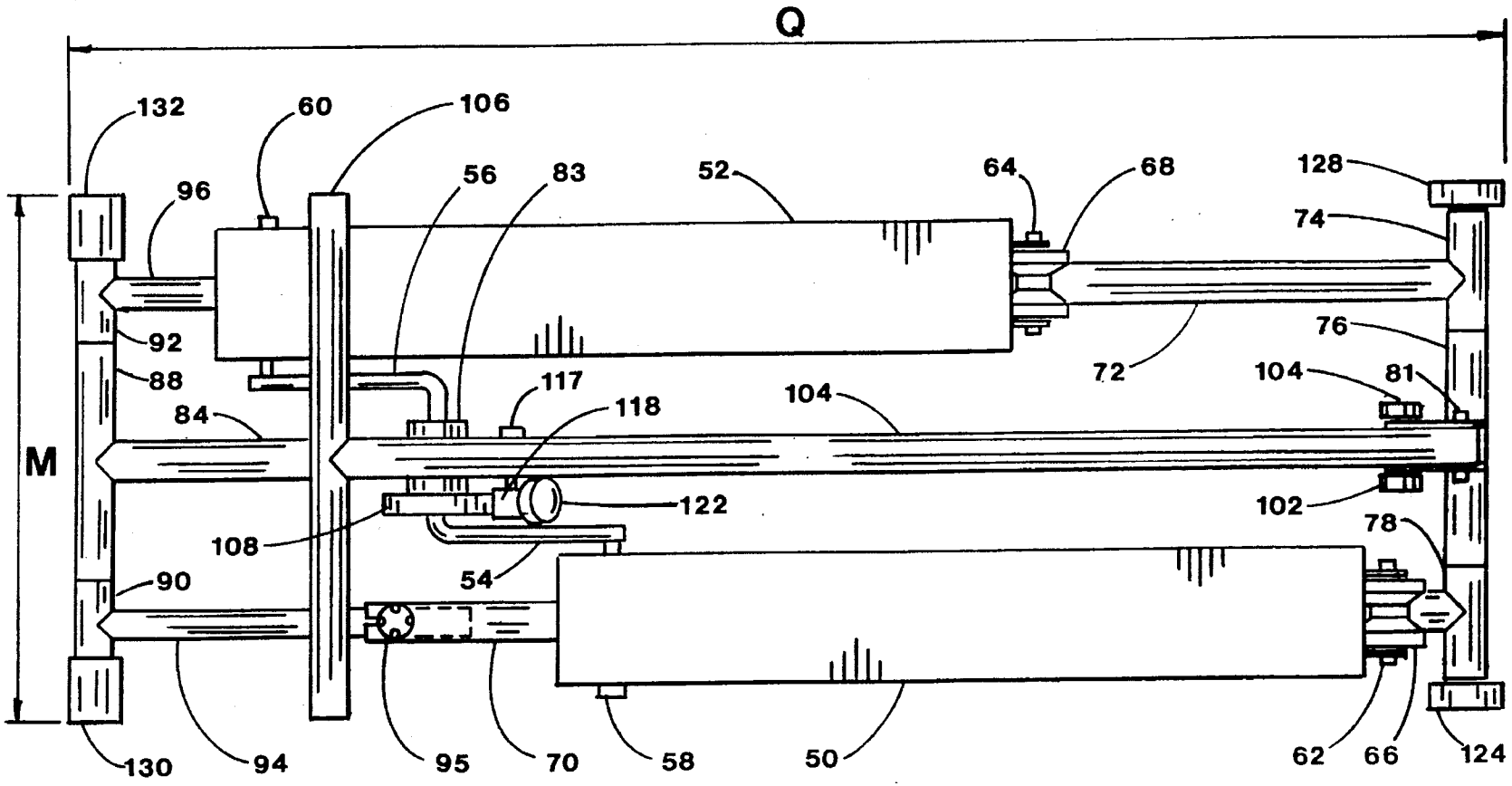
FIG. 3 is a top view of the preferred embodiment shown in FIG. 1 in the collapsed position.
Figure 4:
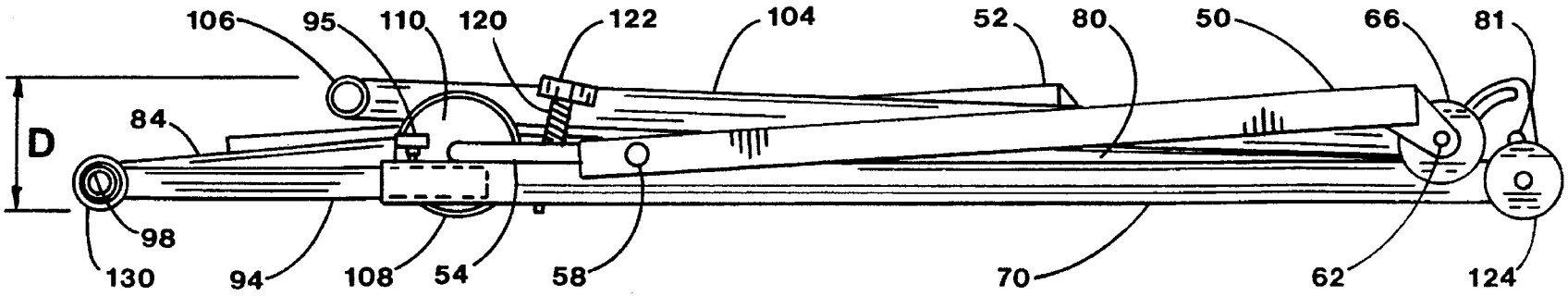
FIG. 4 is a side view of the preferred embodiment in the collapsed position shown in FIG. 3.

The collapsed exercise machine is shown in FIGS. 3 and 4 where frame tubes 80 and 84 are nearly parallel with frame tubes 70 and 72. Crank pins 58 and 60 are in contact with frame tubes 70 and 72 while telescoping tubes 94 and 96 are fully extended. Handlebar support 104 is in contact with bearing housing 83 after knob screws 102 and 104 have been loosened. The brake drum 110 and brake adjustment knob 122 are within the space D limited by handle 106 and frame supports 130 and 132. Floor support for the exercise machine is through rubber wheels 124 and 128 rotatably attached to tubing 75 and rubber supports 130 and 132 concentric with tubes 90 and 92. The collapsed machine is easily rolled about the apartment and under a bed with wheels 124 and 128 when tubes 90 and 92 are used as a handle.

Figure 6:
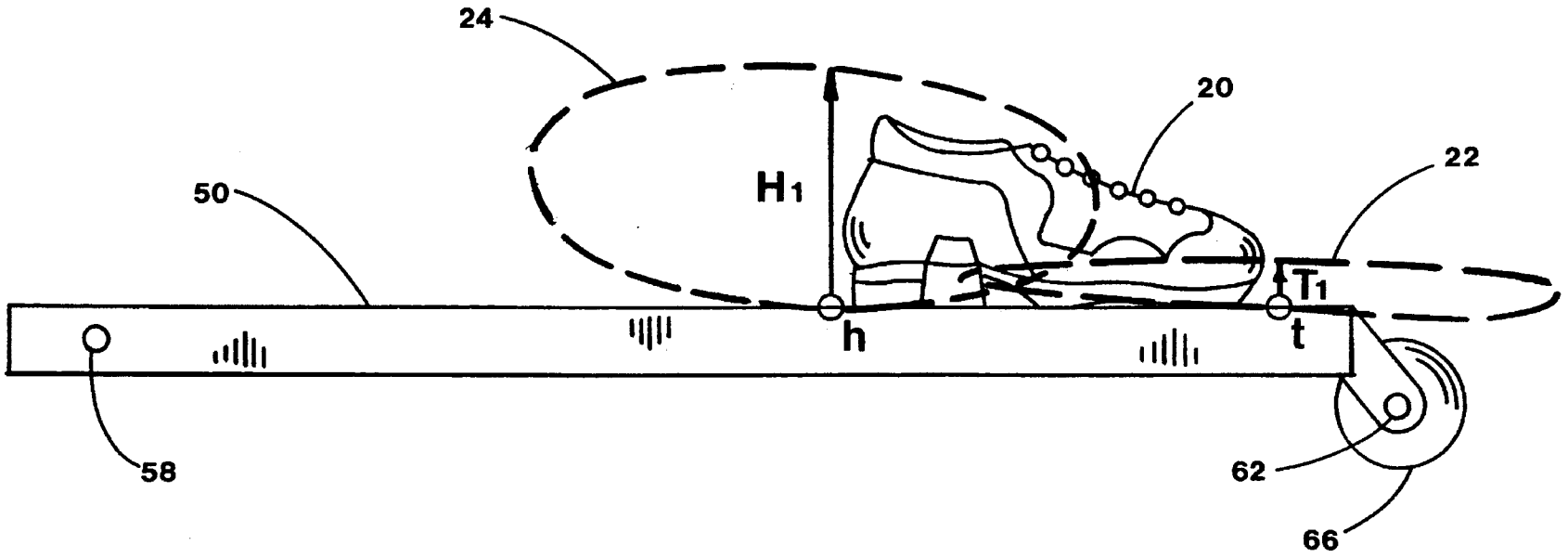
FIG. 6 is a skematic of the footpath curves for the walking mode of the preferred embodiment shown in FIG. 1.

The foot position 20 for walking simulation is shown on elongate pedal 50 in FIG. 6. The toe t describes the toe curve 22 during the pedal cycle while the heel h describes the heel curve 24. The height T1 of the toe curve 22 is measured perpendicular to the elongate pedal shown in the lowermost position of the pedal cycle. The height H1 of the heel curve 24 is measured in a similar manner.

Figure 7:
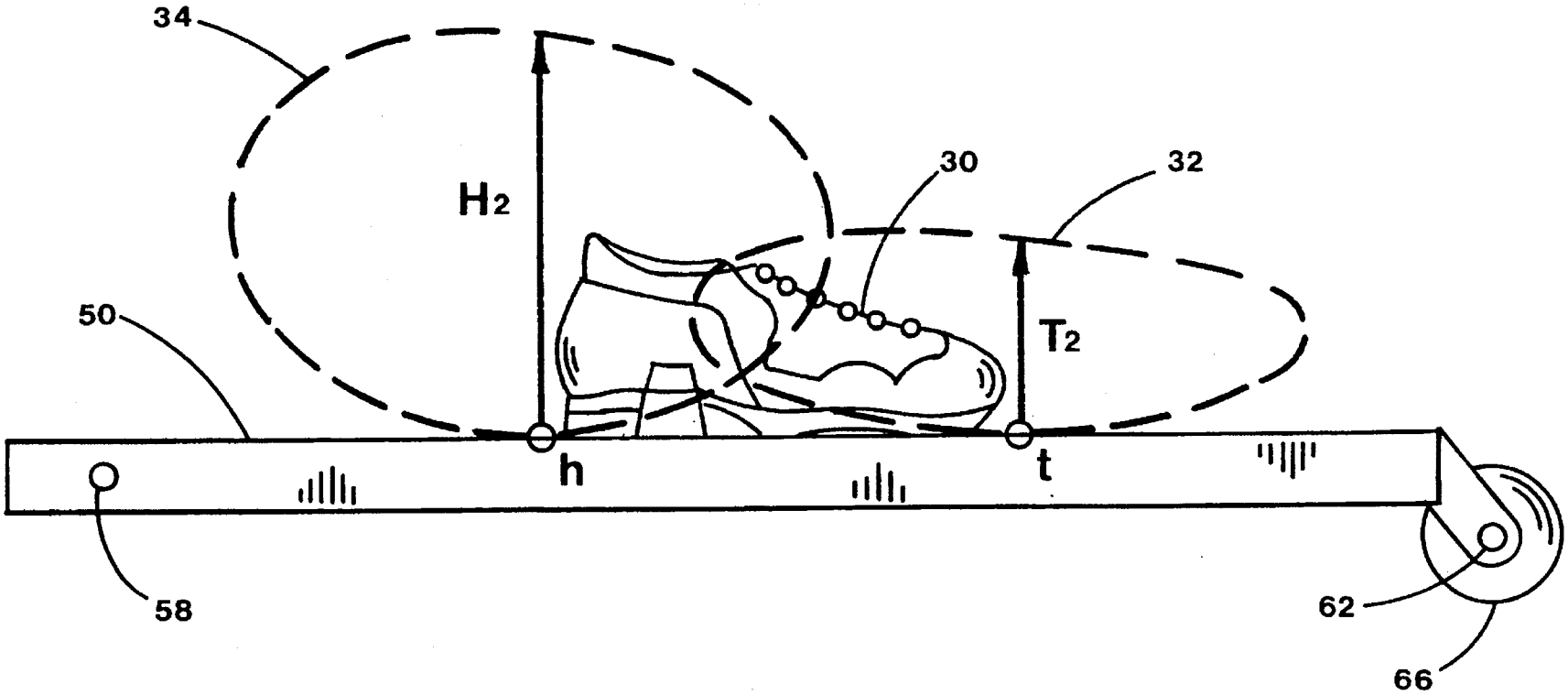
FIG. 7 is a skematic of the footpath curves for the running mode of the preferred embodiment shown in FIG. 1.

The foot position 30 for running simulation is shown on the elongate pedal 50 in FIG. 7. The toe t describes the toe curve 32 during the pedal cycle while the heel h describes the heel curve 34. The height T2 of the toe curve 32 and the height H2 of the heel curve 34 are measured perpendicular to the elongate pedal in the lowermost position of the pedal cycle.

Figure 8:
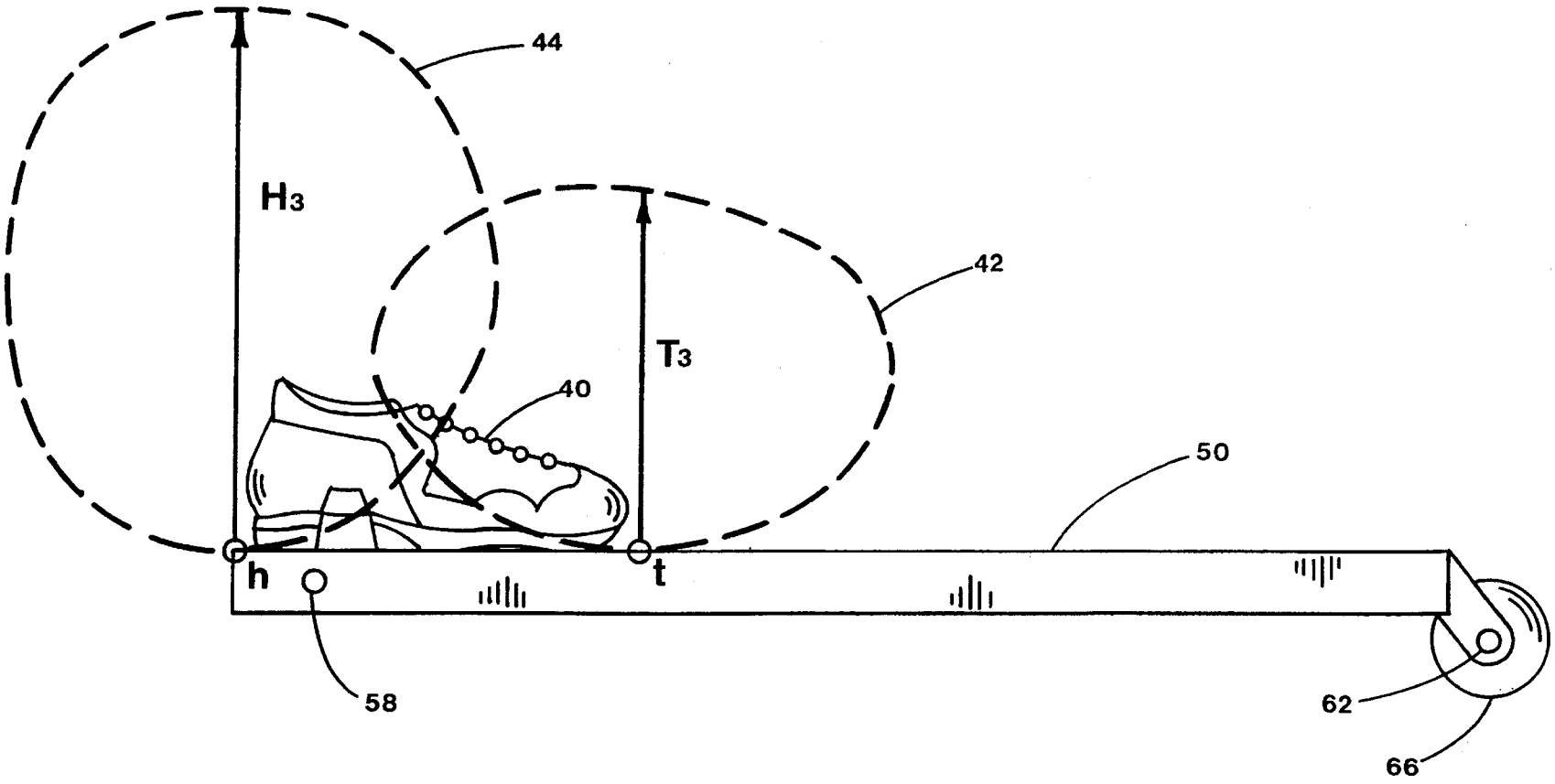
FIG. 8 is a skematic of the footpath curves for the climbing mode of the preferred embodiment shown in FIG. 1.

The foot position 40 for climbing simulation is shown on the elongate pedal 50 in FIG. 8. The toe t describes the toe curve 42 while the heel h describes the heel curve 44 during a pedal cycle. The height T3 of the toe curve 42 and the height H3 of the heel curve 44 are measured perpendicular to the elongate pedal in the lowermost position of the pedal cycle.

Note that the toe curve height T3 is greater than toe curve height T2 and toe curve height T2 is greater than toe curve height T1. Similarly, the heel curve height H3 is greater than heel curve height H2 which is greater than heel height H1.

EXAMPLE—PEDAL LEG CONTROL

Figure 5:
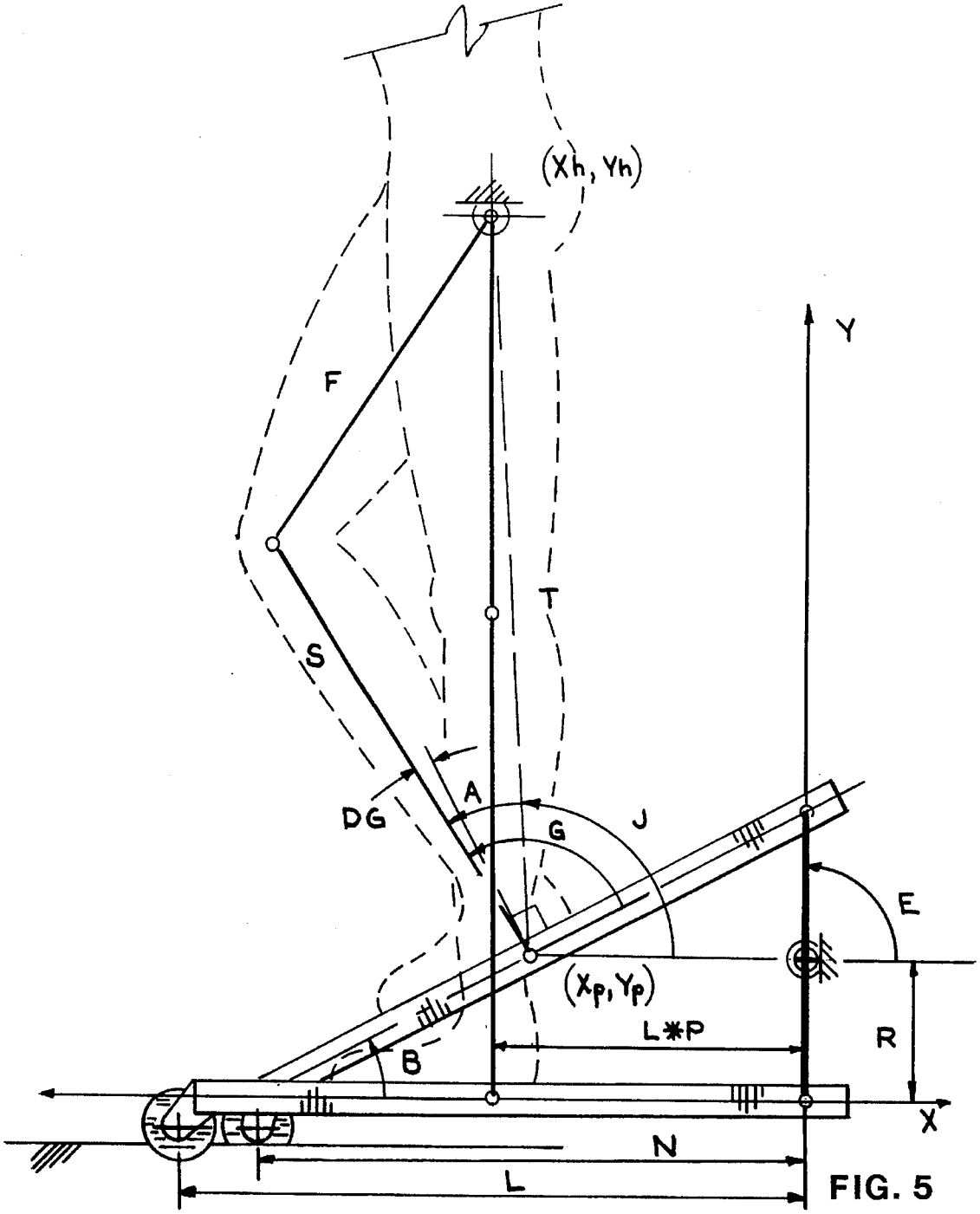
FIG. 5 is a skematic of the preferred embodiment shown in FIG. 1 to express the location of the users lower leg relative to the elongate pedal.

Referring to FIG. 5, the preferred embodiment with the lower torso of the user is shown. The hip joint (Xh, Yh) is assummed to be nearly stationary during operation so that the upper leg F and the lower leg S form a pair of links pivoted at the hip (Xh,Yh), the knee K and at P where the foot is in contact with the pedal L located at a distance of P*L from the crank pin. The Y axis passes through the crankshaft journal located at R units above the X axis where R is the crank length. The angle E locates the crank R position to the X axis. The angle G locates the lower leg S position relative to the elongate pedal L.

As the crank R rotates through a full cycle, an ideally proportioned mechanism will maintain the lower leg S nearly perpendicular to the elongate pedal L or G=90 degrees. This feature is particularly important on the down stroke so that the heel of the foot will support the body weight as is the case with walking or running. The equations leading to a solution for angle G are:

Yh=F+S, Yh=–L,P where P is a percent of L,

W=R*(sin(E)+1)

N=SQRT(L*L–W*W)

Z=R–cos(E)–N

B=ARCTAN(W/N)

Xp=Z+(L–L*P)*cos(B)

Yp=(L–L*P)*sin(B)

J=ARCTAN((Yh–Yp)/(Xh–Xp))

T=SQRT((Yh–Yp)2+(Xh–Xp)2)

A=ARCOS((–F,F+S*S+T*T)/(2*S*T))

G=A+J–B

DG=90–G

A search for a favorable set of parameters yielded the angles:

| DEGREES | | |
|---|---|---|
| E | DG | |
| 0 | −16.6 | F = 18 inch |
| 45 | −13.0 | S = 22 inch |
| 90 | −5.0 | P = 0.5 |
| 135 | 2.0 | R = 6.75 inch |
| 180 | 3.8 | L = 29 inch |
| 225 | 1.0 | |
| 270 | 0.0 | |
| 315 | −12.8 | |

For the down stroke between 90 and 270 degrees the lower leg varies only −5.0 to 3.8 degrees from being perpendicular to the pedal. In the collapsed state, the length Q=53 inch, width M=20 inch and the height D=5 inch such that;

Length+girth(2D+2M)=103 inch

What is claimed is:

1. An exercise machine comprising:

a framework means, said framework means having a first support member means and a second support member means whereby a third support member means connects said first support member means to said second support member means, a crankshaft bearing housing means connected to said third support member means and having a crank means projecting outwardly therefrom on both sides thereof, an elongate pedal means rotatably connected to the end of each crank means being operably associated with said framework means when the foot of the user is rotating said crank means during a pedal cycle and, front and rear pivoting linkages interconnecting the bearing housing means to said support member means, said rear pivoting linkage including an adjustment means whereby said crankshaft bearing housing means can assume different positions to cause the angle of said elongate pedal means to change.

2. The exercise machine according to claim 1 wherein said framework means is collapsible.

3. The exercise machine according to claim 1 which further comprises a load resistance means.

4. The exercise machine according to claim 1 further comprising handle means for each hand of the operator.

5. The exercise machine according to claim 4 wherein said handle means are movable.

6. The exercise machine according to claim 1 whereby the elongate pedal means comprises an elongate pedal having a roller element rotatably attached to said elongate pedal on the pedal end opposite the crank means and where said roller is operably associated with said framework means.

7. The exercise machine according to claim 1 wherein said elongate pedal means has more than one foot position.

8. An exercise machine comprising:

a framework means, said framework means having a first support member means and a second support member means, whereby an adjustment means controls the position of said second support member means relative to said first support member means, a third support member means pivotally connected to said second support member means, a fourth support member means pivotally connected to said first support member means at one end and rotatably connected to said third support member means at the other end, a crankshaft bearing housing means connected to said fourth support member means and having a crank means projecting outwardly therefrom on both sides thereof, an elongate pedal means rotatably connected to the end of each crank means being operably associated with pedal guidance means attached to said framework means to allow said elongate pedal means to move relative to said framework means when the foot of the user is rotating said crank means during a pedal cycle and, front and rear pivoting linkages interconnecting the bearing housing means to said support member means, said rear pivoting linkage including

9. The exercise machine according to claim 8 whereby the elongate pedal means comprises an elongate pedal having a roller element rotatably attached to said elongate pedal on the pedal end opposite the crank means and where said roller is operably associated with said pedal guidance means.

10. The exercise machine according to claim 8 which further comprises a load resistance means.

11. The exercise machine according to claim 8 further comprising handle means for each hand of the operator.

12. The exercise machine according to claim 11 wherein the handle means are movable.

13. The exercise machine according to claim 8 wherein said framework means is collapsible.

14. The exercise machine according to claim 8 wherein said elongate pedal means has more than one foot position.

15. An exercise machine comprising:

a framework means, said framework means having a first support member means and a second support member means whereby a third support member means connects said first support member means to said second support member means, a crankshaft bearing housing connected to said third support member means and having a crank means projecting outwardly therefrom on both sides thereof, an elongate pedal means rotatably connected to the end of each crank means and said elongate pedal means being operably associated with pedal guidance means when the foot of the user is rotating said crank means during a pedal cycle, said pedal guidance means being substantially symmetrical to the horizontal and attached to said framework means, front and rear pivoting linkages interconnecting the bearing housing means to said support member means, said rear pivoting linkage including an adjustment means whereby the angle of said elongate pedal means can be changed and, a handle means whereby the position of said handle means is adjustable during operation of said pedal cycle.

16. The exercise machine according to claim 15 wherein said framework means is collapsible.

17. The exercise machine according to claim 15 which further comprises a load resistance means.

18. The exercise machine according to claim 18 further comprising handle means for each hand of the operator.

19. The exercise machine according to claim 18 wherein said handle means are movable.

* * * * *